US009982648B2

(12) United States Patent
Bauer et al.

(10) Patent No.: US 9,982,648 B2
(45) Date of Patent: May 29, 2018

(54) ELECTRIC MACHINE HAVING A HOUSING IN THE FORM OF A DRIVE BEARING AND HAVING AN INTERNAL GEAR MOUNTED THEREIN

(71) Applicant: Robert Bosch GmbH, Stuttgart (DE)

(72) Inventors: Bernhard Bauer, Althuette (DE); Frank Reschnar, Ilsfeld (DE); Stefan Erlenmaier, Sersheim (DE); Mike Foell, Stuttgart (DE); Jean-Philipp Caro, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days. days.

(21) Appl. No.: 14/840,637

(22) Filed: Aug. 31, 2015

(65) Prior Publication Data

US 2016/0061174 A1 Mar. 3, 2016

(30) Foreign Application Priority Data

Aug. 29, 2014 (DE) ..... 10 2014 217 349

(51) Int. Cl.

| | |
|---|---|
| ***F02N 15/06*** | (2006.01) |
| ***F02N 15/04*** | (2006.01) |
| *F02N 11/00* | (2006.01) |
| *F02N 15/00* | (2006.01) |
| *F02N 15/02* | (2006.01) |

(52) U.S. Cl.

CPC ..... *F02N 15/046* (2013.01); *F02N 11/00* (2013.01); *F02N 15/006* (2013.01); *F02N 15/022* (2013.01); *F02N 15/063* (2013.01); *F02N 15/067* (2013.01)

(58) Field of Classification Search

CPC ..... F02N 15/046; F02N 11/00; F02N 15/006; F02N 15/022; F02N 15/023; F02N 15/063; F02N 15/067

See application file for complete search history.

(56) References Cited

U.S. PATENT DOCUMENTS

| | | | | |
|---|---|---|---|---|
| 4,561,316 | A | 12/1985 | Bolz et al. | |
| 2004/0020315 | A1* | 2/2004 | Vilou | H01H 51/065 74/7 A |

(Continued)

FOREIGN PATENT DOCUMENTS

| | | |
|---|---|---|
| CN | 103775267 A | 5/2014 |
| DE | 19955061 | 5/2001 |

(Continued)

*Primary Examiner* — Zakaria Elahmadi

(74) *Attorney, Agent, or Firm* — Michael Best & Friedrich LLP

(57) ABSTRACT

An electric machine having a housing part which is in the form of a drive bearing (19), having an electric motor (13) as a drive, having a planetary gearing (153) and having a drive element (22), wherein the planetary gearing (153) has a planet gear (16) which meshes with an internal gear (73), and a gear carrier (95) which is coupled to the drive element (22) can be driven by means of the planet gear (160), wherein the internal gear (73) is mounted in damped fashion at least indirectly against the housing part, wherein the internal gear (73) has an engagement element and the housing part has an engagement element, and the two engagement elements engage into one another in alternating fashion, wherein a damping element is arranged between the two engagement elements in a circumferential direction.

18 Claims, 5 Drawing Sheets

(56) References Cited

U.S. PATENT DOCUMENTS

| | | | | |
|---|---|---|---|---|
| 2008/0184845 | A1 | 8/2008 | Farrar et al. | |
| 2011/0094333 | A1 | 4/2011 | Chane-Waye et al. | |
| 2012/0256714 | A1* | 10/2012 | Hartmann | H01H 51/065 335/203 |
| 2016/0061175 | A1* | 3/2016 | Bauer | F02N 15/046 74/6 |

FOREIGN PATENT DOCUMENTS

| | | | | |
|---|---|---|---|---|
| DE | 102012205481 | | 10/2013 | |
| DE | 102013211763 | | 12/2013 | |
| DE | 102013211763 | A1 * | 12/2013 | F02N 15/046 |
| EP | 460824 | | 12/1991 | |
| EP | 863309 | | 9/1998 | |
| GB | 2107425 | | 4/1983 | |

* cited by examiner

ELECTRIC MACHINE HAVING A HOUSING IN THE FORM OF A DRIVE BEARING AND HAVING AN INTERNAL GEAR MOUNTED THEREIN

BACKGROUND OF THE INVENTION

EP 460 824 A1 and EP 0 863 309 A1 have each disclosed electric machines which serve as starter devices for internal combustion engines. For the purposes of varying the rotational speed and torque characteristic of the electric motor provided there as a drive for driving the drive element, which is preferably in the form of a pinion, a planetary gearing is disclosed. Said planetary gearing has an internal gear which is mounted in a housing part, the latter being in the form of a drive bearing. For this purpose, an engagement element of the internal gear engages into an engagement element of the housing or drive bearing.

Provision is made for the damping of the internal gear to be improved and a propagation of vibrations in the housing to be improved.

Low noise, which is acceptable with regard to acoustic impression, in the motor vehicle is of increasing importance. This applies even in the case of a starting process which is completed after only a few seconds. Start-stop applications and, in future, also the so-called "sailing" mode additionally intensify the requirements and demand corresponding acoustically optimized starters. The so-called "sailing" mode refers, in technical terms, to a method in which, during travel on the road, the internal combustion engine is deactivated when it does not need to transmit any drive power, and is reactivated only when drive power has to be transmitted. Such a driving state exists for example when traveling downhill, such that the transmission of a drive torque or drive power becomes necessary, and thus a starting process is rendered necessary during travel, only after a transition for example to travel on a level road or even an uphill road again.

One of the main noise sources in the starter is the planetary gearing, which is commonly designed as an epicyclic gearing. Owing to alternating tooth meshing and, as a result, fluctuations in rigidity, adjacent components are subjected to excitation and are thus caused to vibrate. Some of said vibrations are radiated by said components as airborne noise, or are transmitted to other surrounding starter components or even engine components, that is to say components of the internal combustion engine, as body-borne noise. In the case of the abovementioned gearing designs, those components whose geometric design exhibits only small changes in cross section and low natural frequencies and large radiating surfaces are subjected to direct excitation. Such components therefore have an unfavorable vibration characteristic with regard to the reduction of noise. In particular, the direct connection of the internal gear to the pole housing, the intermediate bearing and the bearing cover are acoustically unfavorable.

Provision is made for the internal gear, as a noise source, to be fastened in the starter such that as few components as possible are subjected to excitation. The required torque support should in this case be realized on symmetrical components with good damping characteristics. Excitation of adjacent components should be prevented or reduced. Furthermore, the construction should permit the use of a damping element.

SUMMARY OF THE INVENTION

It is provided according to the invention that the electric machine is equipped with a housing, which is in the form of a drive bearing, with an electric motor as a drive, with a planetary gearing, and with a drive element. The planetary gearing has at least one planet gear which meshes with an internal gear, wherein a gear carrier which is coupled to the drive element can be driven by means of the at least one planet gear, wherein the internal gear is mounted in damped fashion at least indirectly against the housing, wherein the internal gear has at least one engagement element and the housing has at least one engagement element, and the at least two engagement elements engage into one another in alternating fashion. Here, provision is made for a damping element to be arranged between the at least two engagement elements in a circumferential direction in order to reduce the transmission of vibrations from the internal gear to the housing.

If the at least one engagement element of the internal gear is a peg and the at least one engagement element of the drive bearing is a groove, an internal gear is realized which has fewer notches that could lessen the mechanical load capacity of the internal gear. If, in an alternative embodiment, the at least one engagement element of the internal gear is a groove and the at least one engagement element of the drive bearing is a peg, the mass of the internal gear tends to be greater than in the inverse situation. This is because, owing to the grooves on the outer circumference and the action thereof as notches, the ring of the internal gear must, overall, be designed to be somewhat thicker in order to attain the same strength. This has the advantage that, in this way, that is to say owing to the higher mass of the internal gear, there is tendentially reduced excitation of the housing by high frequencies. The internal gear reacts less readily to excitations.

Provision is furthermore made for an intermediate bearing carrier to be arranged between the internal gear and the drive element (preferably cranking pinion). Said intermediate bearing carrier should likewise be mounted in the housing, wherein the intermediate bearing carrier has at least one engagement element and the housing has at least one engagement element, and the at least two engagement elements engage into one another in alternating fashion. This has the effect that forces (transverse forces and/or tangential forces and/or radial forces) which are imparted by the drive element and which are for example introduced into the intermediate bearing carrier are transmitted into the housing without the internal gear being adversely affected by said forces. As viewed from the drive element, said forces are absorbed in the housing already upstream of the internal gear. This may be realized for example by way of a cylindrical fit of the intermediate bearing carrier, which is fitted into a cylindrical receptacle of the housing, and/or by way of engagement elements preferably integrally formed on the intermediate bearing carrier. Forces (transverse forces and/or tangential forces and/or radial forces) acting on the internal gear are then transmitted into the housing for the first time axially (axis of rotation of planet gear shaft) downstream of the cylindrical fit of the intermediate bearing carrier. Alternatively or in addition, it is also possible for the forces exerted on the intermediate bearing carrier to be transmitted into the housing at the same circumferential position of the internal gear, which in turn may be realized by way of at least one engagement element preferably integrally formed on the intermediate bearing carrier. In a further alternative, or in addition, it is also possible for the forces exerted on the intermediate bearing carrier to be transmitted into the housing at the same axial position of the internal gear, which in turn may be realized by way of at least one engagement element preferably integrally formed on the intermediate bearing carrier.

By means of this form of decoupling, the at least one planet gear rolling in the internal gear is relieved of corresponding forces and consequently imparted vibrations, and thus the durability of the planetary gearing is increased, and the generation of noise is also reduced. Said decoupling also acts conversely: rotational accelerations imparted by the sun gear and associated torque fluctuations are transmitted into an engagement element of the drive bearing in damped fashion via at least one engagement element of the internal gear. By means of the intermediate bearing carrier, which is decoupled from the internal gear, between the pinion and the planetary gearing, the intermediate bearing carrier is merely damped, and is only indirectly subjected to force fluctuations. In this way, the excitation of the intermediate bearing carrier is considerably reduced, such that in particular, the areal regions of the intermediate bearing carrier are subjected to considerably reduced excitation. In one variant, provision may also be made for the at least one engagement element of the intermediate bearing carrier and the at least one engagement element of the internal gear to be of the same type (peg or groove), and accordingly, for the engagement elements of the internal gear and also of the intermediate bearing carrier, designed for example as pegs, to engage into a common groove of the housing. Provision may alternatively be made for an engagement element of the housing, designed as a peg, to engage both into a groove of the intermediate bearing carrier and into a groove of the internal gear, for engagement into one another in alternating fashion. It is provided in particular that an engagement element of the intermediate bearing carrier and an engagement element of the internal gear are of the same type and engage into the same engagement element of the housing. Provision may alternatively be made for at least one engagement element of the intermediate bearing carrier to engage into at least one counterpart or engagement element of the housing, and for an engagement element of the internal gear to engage into a counterpart or engagement element of the housing, wherein the engagement element of the housing for the internal gear is a different engagement element than the engagement element for the intermediate bearing carrier in the housing.

In a further alternative, provision is made for at least one engagement element of the internal gear and at least one engagement element of the intermediate bearing carrier to alternate on an inner circumference of the housing, wherein, between an engagement element of the internal gear and an engagement element of the intermediate bearing carrier, there is arranged at least one damping element and at least one web which is integrally connected to the housing.

In a further alternative, provision is made for at least one engagement element of the internal gear and at least one engagement element of the intermediate bearing carrier to be arranged at the same circumferential position of the housing, wherein at least one damping element is arranged between an engagement element of the internal gear and an engagement element of the intermediate bearing carrier. The latter has the advantage that the damping element is arranged in an axial direction between positionally fixed objects (engagement elements). In this way, it is for example possible for a relative movement to be at least substantially prevented, and thus for the damping element to be of improved design with regard to wear.

The preferred embodiment of the decoupling provides that the internal gear is mounted in the housing part in damped fashion by means of at least one damper, and the at least one damper is braced between two intermediate bearing carriers. In this way, the internal gear is axially decoupled. Owing to the arrangement of the internal gear in the housing part by way of the at least one damper, decoupling in a circumferential direction and in a radial direction is realized at the same time.

According to a further proposal, it is provided that, in a groove in the housing, a damping element is delimited in an axial direction by a web, which is for example an engagement element of the intermediate bearing carrier, and in another axial direction by a web of a cover, wherein the cover is preferably formed as a further intermediate bearing carrier and serves for mounting a rotor shaft of the electric motor. Provision is preferably furthermore made for a web on the inner circumference of the housing to be connected in electrically conductive fashion to a component of the electric motor, preferably to a pole tube of the electric motor, preferably by abutment at a face side. This makes it possible to realize an electrical current-conducting path from the component of the electric motor, which is electrically connected for example to the so-called negative brushes, via the housing to a negative terminal, preferably a ground path, on the housing of the internal combustion engine.

The inventions are not restricted to so-called free-ejecting starting devices. The inventions may likewise be used in the case of so-called claw-type starters. In the case of claw-type starters, the drive bearing shield engages over the cranking pinion in the manner of a claw, cf. also DE 199 55 061 A.

BRIEF DESCRIPTION OF THE DRAWINGS

The exemplary embodiments are illustrated below in several figures, in which.

DETAILED DESCRIPTION

Figure 1:
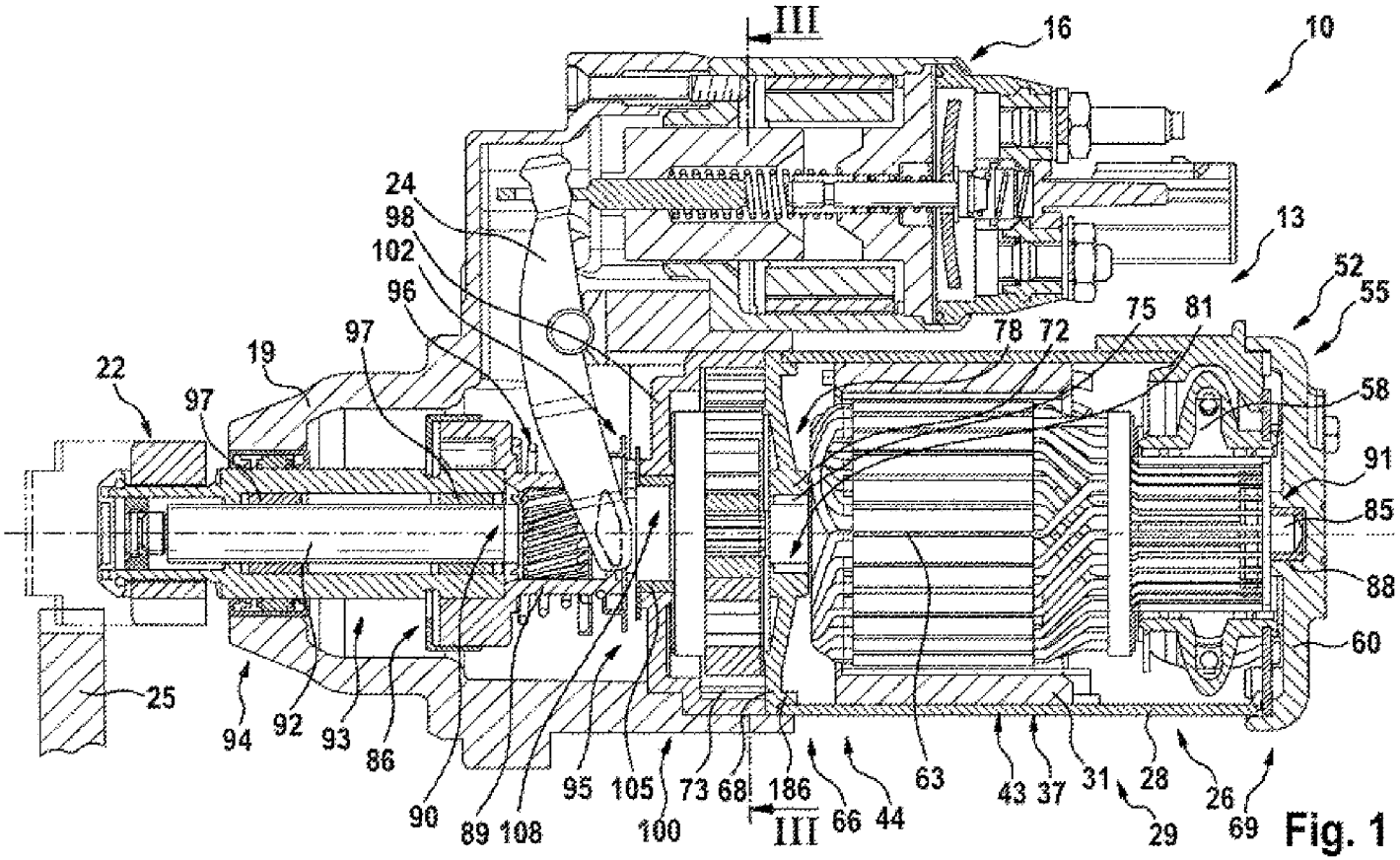
FIG. 1 shows a longitudinal section through a starting device according to the invention.

FIG. 1 shows an electric machine 10, configured as a starting device, in a longitudinal section. Said starting device has for example a starter motor 13 and a pre-engagement actuator 16, which is for example designed as a relay or starter relay. The starter motor 13 and the electrical pre-engagement actuator 16 are fastened to a common drive bearing shield 19. In functional terms, the starter motor 13 serves to drive a drive element 22, which in this case is in the form of a cranking pinion, in rotation when said drive element is engaged into the toothed ring 25 of the internal combustion engine (not illustrated here).

The starter motor 13 has a housing 26 with a pole tube 28 which bears poles 31 on its inner circumference. A stator 29 is formed in this way. The poles 31 in turn surround a rotor 37 (armature) which has an armature assembly 43 constructed from lamellae and has an armature winding arranged in grooves. Furthermore, a commutator 52 is attached to that end of a drive shaft 44 which is averted from the drive element 22. The commutator 52, or the commutator lamellae 55 thereof, are supplied with electrical current during operation by way of carbon brushes 58.

In each case one support bearing arrangement 66 and 69 is situated on each side of the rotor 37 in the direction of an axis of rotation 63. The support bearing arrangement 66 is optional. The optional support bearing arrangement 66 between the cranking pinion or the drive element 22 and the armature assembly 46 is in this case constructed as follows: in the pole tube 28 there is inserted an intermediate bearing carrier 68, which in this case is arranged between an internal gear 73 and the armature assembly 43. The intermediate bearing carrier 68 has a central receptacle 72, which carries a substantially cylindrical bearing bushing 75. The receptacle 72 has a rim 78 which prevents a displacement of the bearing bushing 75 in the direction of the drive element 22. The drive shaft 44 is supported in the bearing bushing 75. A special, in particular smooth bearing section 81 serves for this purpose. The support bearing arrangement 66 is suitable for exerting both axial and radial bearing forces on the mounted part.

The other support bearing arrangement 69 is situated on the other side of the rotor 37, that is to say on that side of the rotor which is averted from the drive element 22. The support bearing arrangement 69 is in this case constructed such that a shaft peg 85, which is for example formed in one piece with the drive shaft 44, is mounted in a bushing 88. The bushing 88 is in turn received in a pot-shaped protuberance 91. The protuberance 91 is formed in one piece with the bearing cover 60 which closes off the housing 26.

As viewed from the drive element 22, the following components, stated here in abbreviated form, are situated between the drive element 22 and the internal gear 73: the drive element 22 is seated on a hollow shaft 93 which is mounted in rotatable fashion in a roller bearing 94 in the drive bearing shield 19. The right-hand end of the drive shaft forms an inner ring of a freewheel 86. Said freewheel 86 in turn runs in a driver shank 89 which, on its inner side, has a high-pitch thread internal toothing 90. Said high-pitch thread internal toothing 90 meshes with a high-pitch thread external toothing 96 formed on an outer side of a planet gear shaft 92. The planet gear shaft 92 serves, by way of two plain bearing bushings 97, for the mounting of the abovementioned output shaft, and at its right-hand end, that is to say its end facing toward the planetary or epicyclic gearing, said planet gear shaft ends preferably in a planet carrier 95.

The construction described below describes the arrangement on both sides of the internal gear 73. Between the internal gear 73 and a shoulder 100 in the drive bearing shield 19 there is preferably situated an intermediate bearing carrier 98. Said intermediate bearing carrier 98 has a central bearing receptacle 102, which substantially has an internal cylindrical contour. Said internal cylindrical contour receives a plain bearing 105. The plain bearing 105 supports the planet gear shaft 92 between the planet carrier 95 and the high-pitch thread. Between the bearing receptacle 102 or the plain bearing 105 and the planet carrier 95 there is situated a collar 108 which prevents a displacement of the plain bearing 105 in the direction of the planet carrier 95.

Figure 2:
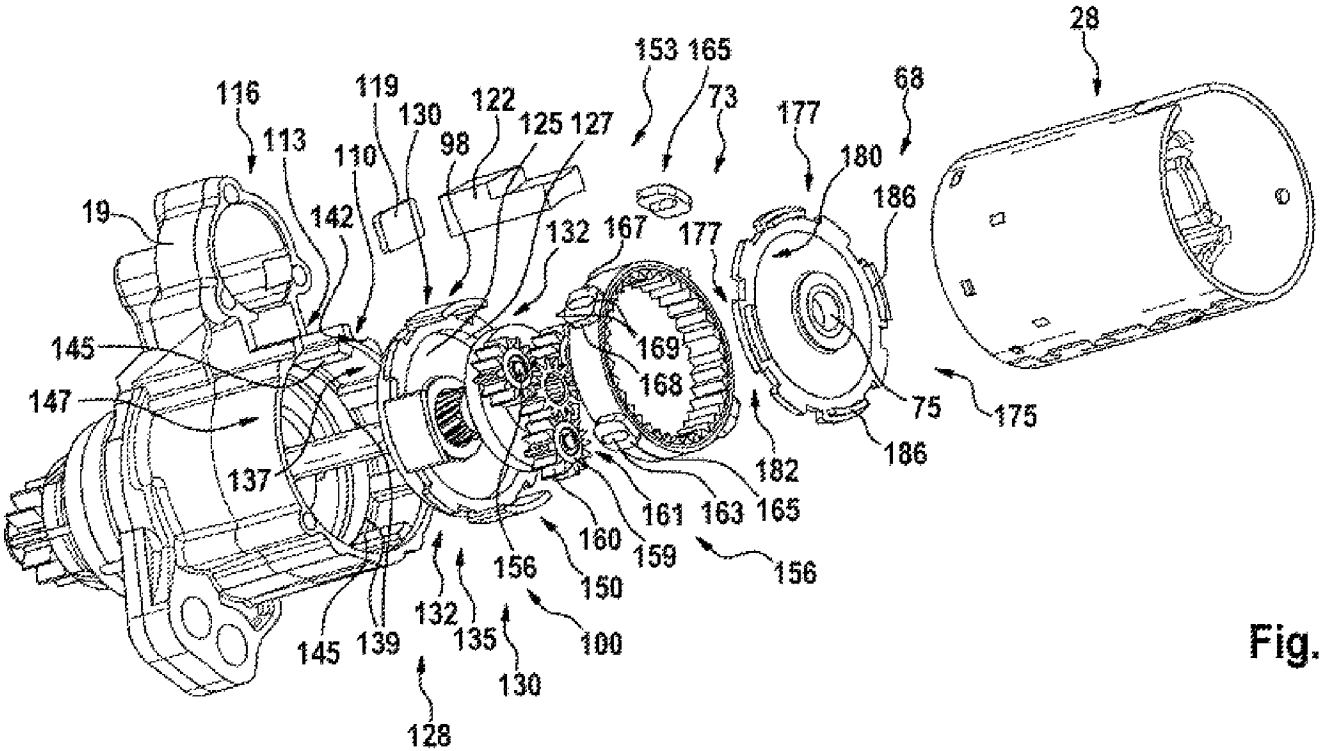
FIG. 2 shows an exploded illustration of a part of the electric machine from FIG. 1.

FIG. 2 shows an exploded illustration of some parts of the first exemplary embodiment. The drive bearing shield 19 has a first opening 110 into which the intermediate bearing carrier 98 is inserted. Via an opening 113 for the mounting of a fork lever (not illustrated here but already illustrated in FIG. 1), an opening 116 into which the pre-engagement actuator 16 (engagement relay) engages is connected to the opening 110. A plate 119 serves as a rotary bearing for bolt stubs (not illustrated here) of the fork lever (not illustrated here) for force absorption. A sealing element 122 is forced against the plate 119 by the pre-engagement actuator 16.

The intermediate bearing carrier 98 has, overall, a flat pot shape with the central bearing receptacle 102 and the central opening thereof. Situated adjacently radially to the outside, there is a ring-shaped shield region 125 which transitions into an axially short ring-shaped wall 127. A ring-shaped collar 128 extends radially outward from said ring-shaped wall 127. Various regions which are formed integrally on the intermediate bearing carrier 98 extend in a circumferential direction from said ring-shaped collar 128. Accordingly, four shield regions 130 are situated opposite one another at substantially 90° intervals. Between the shield regions 130 there are situated three arc segment-shaped webs 132. Between the total of four webs 132 and the shield regions 130 there is situated in each case one intermediate space 135. Between two shield regions 130 there is thus situated an intermediate space 135 followed by a web 132 and a further intermediate space 135. The shield regions 130 are substantially of cylindrical shell shape.

The webs 132 have a rear wall 137, said rear walls bearing against a face surface 139 of the shoulder 100. The shield regions 130 likewise have a rear wall 142, said rear walls bearing against a face surface 139 of the shoulder 100.

The cylindrical part of the shoulder 100, a fit for the intermediate bearing carrier 98, absorbs transverse forces which act via the drive element 22.

Viewing the opening 110 of the housing which is in the form of a drive bearing shield 19, a structure can be seen on the inner circumference of the housing. Here, said structure comprises, for example, inwardly oriented webs 145 which are interrupted by intermediate spaces 147. In this example, in this case cf. also FIG. 3, it is thus the case that a total of eight webs 145 and eight intermediate spaces 147 alternate with one another on the inner circumference of the opening 110. As a result of the intermediate bearing carrier 98 being pushed in, the four shield regions 130 and also the four webs 132 are pushed into the cylinder ring segment-shaped intermediate spaces 147, in each case into an intermediate space 147 between two webs 145, until the mentioned rear walls 137 and 142, respectively, of the shield regions 130 and webs 132 bear against the face surface 139 between the webs 145.

As the intermediate bearing carrier 98 is pushed in, the shaft 92 is installed with the intermediate bearing carrier 98, that is to say a flange 150 of the planet gear carrier of the planetary gearing 153 protrudes in front of the shield region 125. In this case, three gear pins 156 are inserted into the flange 150. On said gear pins there is seated in each case one plain bearing bushing 159 or a needle-roller sleeve, which is pressed into a planet gear 160, said gear pins in this case being for example planet gear spindles. A sun gear 161 is situated centrally between the in this case three illustrated planet gears 160. The sun gear 161 has, centrally, a toothing which serves as a driver. Said toothing serves ultimately for being plugged onto the rotor shaft. The internal gear 73 is arranged in ring-shaped fashion around the for example three planet gears 160. Said internal gear has, on its outer circumference, preferably four pegs 163 which interrupt the substantially cylindrical outer circumference. The four pegs 163 in this example are spaced apart at 90° intervals. On each peg 163 there is seated a damping element 165. Said damping element 165 is in this case designed such that in each case one block element 167 and block element 168 is arranged in both one circumferential direction and in the other circumferential direction proceeding from a peg 163, such that a block element 167 as a damping element is arranged in a circumferential direction between the at least two engagement elements. The block elements may have a different extent in the circumferential direction and thus, if appropriate, impart damping with different intensity in the different circumferential directions (clockwise, counter-clockwise). This is dependent on the intended operating direction of the electric motor 13. The block elements 167 and 168 are in each case integrally connected to one another, past the peg 163, by way of damper webs 169. The damper webs 169 each have an axial face direction which is substantially flattened.

The internal gear 73 thus pre-installed is in this case arranged such that the pegs 163 with the damping elements 165 are arranged between the shield regions 130, approximately centrally between these. In each case one web 169 of a damping element 165 is then, in the intended position, situated directly opposite a web 132. Finally, in this example, the further intermediate bearing carrier 68 is installed. Said intermediate bearing carrier is preferably of shield-like form, that is to say a closed ring-shaped wall 175 is provided between an outer circumference of the intermediate bearing carrier and the bushing 75. Radially outside the ring-shaped wall 175 there is situated an outer contour which is interrupted by intermediate spaces 177. Thus, said outer contour has multiple webs 180 and 182. The webs 180 and 182 alternate on the outer circumference of the intermediate bearing carrier 68. The webs 180 are adapted, in terms of their extent in the circumferential direction, to the webs 132. The webs 182 in turn are adapted to the circumferential extent of the shield regions 130. Offset radially inward slightly from the outer circumference of the intermediate bearing carrier 68, it is preferably the case that four arcuate webs 186 extend in an axial direction, said webs serving, by way of their radially outer side, for centering the pole tube 28 at the inner circumference thereof, cf. also FIG. 1.

Figure 3:
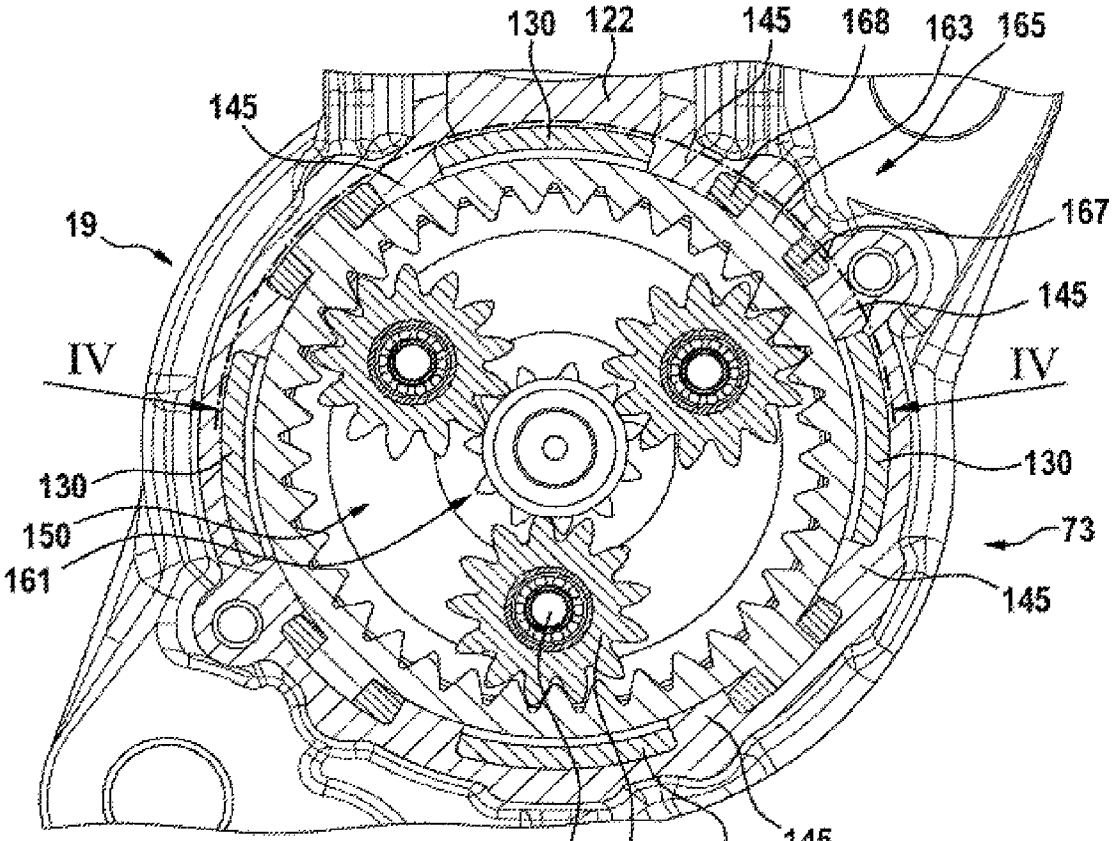
FIG. 3 shows a cross section through the electric machine from FIG. 1.

FIG. 3 illustrates a cross section corresponding to the section line in FIG. 1. Between two webs 145 which receive a peg 163 between them, a block element 168 is arranged between the peg 163 and a web 145 in one circumferential direction, and another block element 167 of a damping element 165 is arranged between said peg 163 and web 145 in the other circumferential direction. Between two exemplary webs between which no peg 163 is arranged, there is situated a shield region 130. This illustration does not show that a web 132 is arranged between two webs 145 which receive a peg 163 between them. This means that, as seen in the viewing direction of the viewer of FIG. 3, a web 132 is arranged behind the two block elements 167 and 168 and behind the peg 163.

Figure 4:
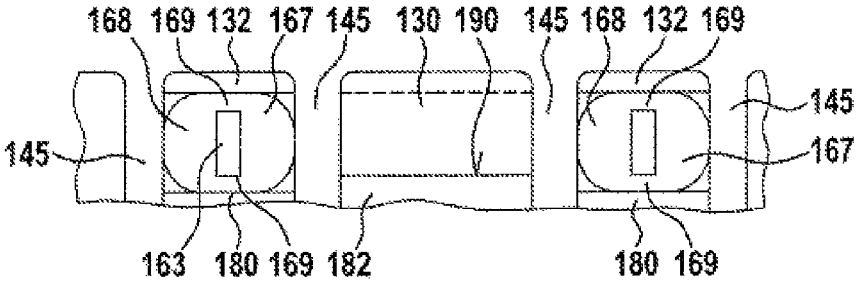
FIG. 4 shows a circumferential section as per the section line in FIG. 3.

This is illustrated in FIG. 4. Said figure illustrates, corresponding to the section line IV-IV in FIG. 3, a developed view radially from the outside corresponding to the section line. It can be clearly seen here that the webs 132 and 180 receive the damping element 165 between them. Between the two other webs 145, which receive the shield region 130 between them, there is also situated the web 182, which is oriented with a face surface 190 toward the shield region 130.

FIGS. 1 to 4 show an electric machine 10 which is designed as a starter or starting device. The electric machine 10 has a housing part designed as a drive bearing 19. Furthermore, said machine has an electric motor 13 as a drive and has a planetary gearing 153. A drive element 22 is driven, or can be driven, by the electric motor 13. The drive element 22 is for example designed as a drive pinion or cranking pinion. The planetary gearing 153 has, for example, a planet gear 160—three planet gears are preferably provided in the example—which meshes with an internal gear 73. A gear carrier 95, which in this case is for example a planet gear carrier, can be driven by the planet gear 160. The gear carrier 95 is coupled to the drive element 22, such that the drive element 22 can be driven by way of the electric motor 13. The internal gear 73 is mounted in damped fashion at least indirectly against the housing part. The damping elements 165 preferably serve for this purpose. The internal gear 73 has an engagement element, and the housing part likewise has an engagement element, wherein the two engagement elements engage into one another in alternating fashion. The engagement element of the internal gear 73 is in this case preferably in the form of a peg 163, and the engagement element of the housing part is preferably in the form of a web 145 or webs 145. The alternating engagement of the engagement elements of the internal gear 73 and of the housing part is shown more clearly for example in FIG. 3 and FIG. 4. Provision is made for a damping element 165 to be arranged between the two engagement elements in a circumferential direction, which damping element absorbs, transmits and dampens tangential forces and possibly also radial forces. For this purpose, provision is preferably made for the damping element 165 to be arranged between the two engagement elements of web 145 or webs 145 and a peg 163. Provision is thus preferably made for the engagement element of the internal gear to be in the form of a peg 163 and for the engagement element of the drive bearing 19 to be in the form of an intermediate space 147 formed as a groove, preferably between two webs 145. Provision is made for the intermediate bearing carrier 98 to have an engagement element and for the housing part to have an engagement element, and for the two engagement elements to engage into one another in alternating fashion.

Provision is furthermore made for an intermediate bearing carrier 98 to be arranged between the separate internal gear 73 and the drive element 22. Provision is made for the intermediate bearing carrier 98 and the separate internal gear 73 to be displaceable relative to one another. The intermediate bearing carrier 98 is mounted in the housing part, wherein the intermediate bearing carrier 98 has an engagement element and the housing part has an engagement element. The two engagement elements engage into one another in alternating fashion. In particular, provision is made for the intermediate bearing carrier 98 to have a web 132 as engagement element, and for the housing part to have an intermediate space 147, between two webs 145, as engagement element.

As is illustrated inter alia in FIG. 3, in the case of the electric machine, it is provided in particular that an engagement element of the internal gear, preferably in the form of a peg 163, and an engagement element of the intermediate bearing carrier 98 are arranged at the same circumferential position of the housing part. Here, provision is made for at least one damping element 165 to be arranged between an engagement element of the internal gear 73 and an engagement element of the intermediate bearing carrier 98. Provision is made in particular for the damping element 165 to be arranged between a peg 163, as engagement element of the internal gear 73, and an engagement element, in the form of a web 132, of the intermediate bearing carrier 98.

It is furthermore provided that, in an intermediate space 147 in the housing part, a damping element 165 is delimited in one axial direction by a web 132, as engagement element of the intermediate bearing carrier 98, and in another axial direction by a web 180 of a cover, wherein the cover is preferably formed as a further intermediate bearing carrier 68 and serves for mounting a rotor shaft 84 of the electric motor 13. The engagement element of the intermediate bearing carrier 98 and the engagement element of the internal gear 73 are thus mounted one axially one behind the other in the housing part in relation to an axis of rotation of the gear carrier.

Figure 5:
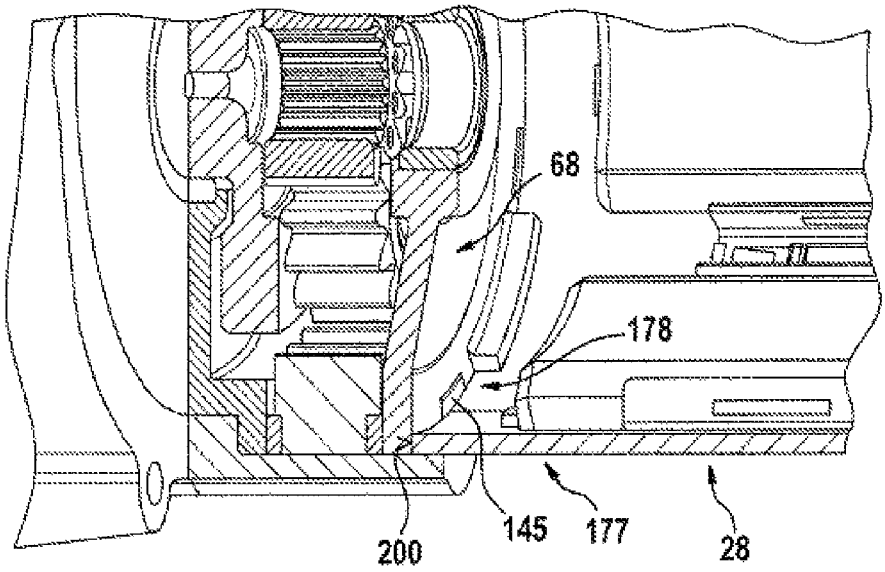
FIG. 5 shows the three-dimensional view of a partial section through a detail of the electric machine from FIG. 1.

FIG. 5 shows a further detail of the first exemplary embodiment. As can be clearly seen, a web 145 projects through an intermediate space 177 of the intermediate bearing carrier 68. Pole housing screws (not illustrated here) which press the brush-side cover 60 against the pole tube 28, and press the latter against the webs 145, thus produce electrically conductive contact between an axially oriented face surface 178 of a web 145 and a face surface, oriented oppositely to said face surface 178, of the pole tube 28. The corresponding face surface of the pole tube 28 is denoted by the reference sign 200.

Figure 6:
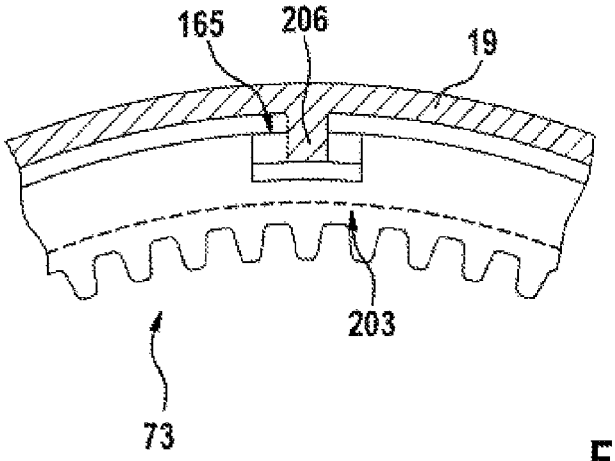
FIG. 6 shows a detail sectional illustration through a second exemplary embodiment of the electric machine.

FIG. 6 shows a modified form of engagement between the internal gear 73 and the housing part or drive bearing 19. In this case, the engagement element of the internal gear 73 is a groove 203, and the engagement element of the drive bearing 19 is an inwardly directed peg 206. In this case, too, the damping element 165 would preferably be arranged for example between a web 132, which is for example slotted owing to the peg 206, and a web 180.

Figure 7:
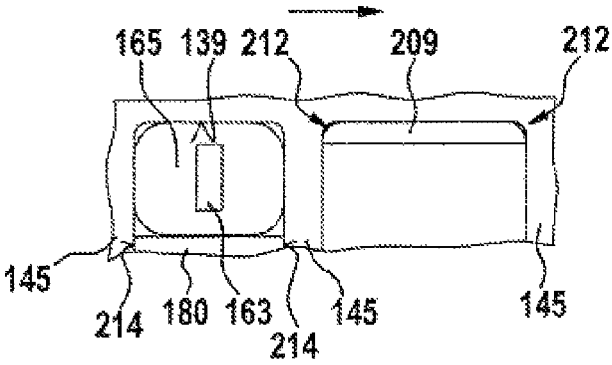
FIG. 7 shows a developed view, analogous to the illustration as per FIG. 4, of a further exemplary embodiment.

FIG. 7 illustrates a modification of the first exemplary embodiment. Summarized in abbreviated form, the modification relates primarily to the intermediate bearing carrier 98, which in this case no longer has the webs 132 and also no longer has the shield regions 130. Instead of the shield regions 130, it is merely the case here that webs 209 similar to the webs 132 are provided. The main difference here is that the damping element 165 is braced or arranged in an axial direction between a face surface 139 and a web 180 of an intermediate bearing carrier 68. As it is consequently the case in exemplary embodiment 1 that forces are supported in a circumferential direction between the intermediate bearing carrier 98 and the housing part or drive bearing 19, for example by way of the webs 132 and the abutment surfaces thereof against the webs 145 in a circumferential direction, and/or alternatively by way of abutment surfaces of the shield regions 130, which are likewise oriented in the circumferential direction toward the webs 145, it is the case in this variant that the circumferential forces of the intermediate bearing carrier 98 are supported via the face surfaces 212, oriented in the circumferential direction, against the webs 145. Here, the transverse forces or circumferential forces in the circumferential direction of the intermediate bearing carrier 68 are supported by way of the webs 180 and the face surfaces 214 thereof, which are likewise oriented in the circumferential direction and are supported in the circumferential direction against the webs 145.

In this arrangement as per FIG. 7, too, the contact between the webs 145 and the face surface 200 of the pole tube 28 may be realized as in FIG. 5. The modification of exemplary embodiment 1 shown in FIG. 6 may likewise also be implemented in the exemplary embodiment as per FIG. 7.

What is claimed is:

1. An electric machine comprising a housing part which is in the form of a drive bearing (19), an electric motor (13) as a drive, a planetary gearing (153), and a drive element (22), wherein the planetary gearing (153) has at least one planet gear (160) which meshes with an internal gear (73) and a gear carrier (95) that is coupled to the drive element (22) and that is configured to be driven by the at least one planet gear (160), wherein the internal gear (73) is mounted in damped fashion at least indirectly against the housing part, wherein the internal gear (73) has at least one engagement element and the housing part has at least one engagement element, and the at least two engagement elements engage into one another in alternating fashion, and the electric machine further comprising a damping element (165) is arranged between the at least two engagement elements in a circumferential direction; and wherein an intermediate bearing carrier (98) is arranged between the separate internal gear (73) and the drive element (22), and the intermediate bearing carrier (98) is mounted in the housing part, wherein the intermediate bearing carrier (98) has at least one engagement element, and wherein the at least two engagement elements of the intermediate bearing carrier (98) and the housing part engage into one another in alternating fashion.

2. The electric machine according to claim 1, wherein the at least one engagement element of the internal gear (73) is a peg (163) and the at least one engagement element of the drive bearing (19) is an intermediate space (147).

3. The electric machine according to claim 1, wherein the at least one engagement element of the internal gear (73) is a groove (203) and the at least one engagement element of the drive bearing is a peg (206).

4. The electric machine according to claim 1, wherein the at least one engagement element of the internal gear (73) and the at least one engagement element of the intermediate bearing carrier (98) alternate in the inner circumferential position of the housing, wherein, between the engagement element of the internal gear (73) and the engagement element of the intermediate bearing carrier (98), there is arranged the at least one damping element (165) and at least one web (145) which is integrally connected to the housing.

5. The electric machine according to claim 1, wherein the engagement element of the internal gear (73) and the engagement element of the intermediate bearing carrier (98) are arranged at the same circumferential position of the housing part, wherein the damping element (165) is arranged between the engagement element of the internal gear (73) and the engagement element of the intermediate bearing carrier (98).

6. The electric machine according to claim 5, wherein, in an intermediate space (147) in the housing part, the damping element (165) is delimited in one axial direction by a web (132) of the intermediate bearing carrier (98) and in another axial direction by a web (180) of a cover.

7. The electric machine according to claim 1, wherein a web (145) on the inner circumference of the housing part is connected in electrically conductive fashion to a component of the electric motor (13).

8. The electric machine according to claim 5, wherein, in an intermediate space (147) in the housing part, the damping element (165) is delimited in one axial direction by a web (132) of the intermediate bearing carrier (98) and in another axial direction by a web (180) of a cover, wherein the cover is formed as a further intermediate bearing carrier (68) and serves for mounting a rotor shaft (84) of the electric motor (13).

9. The electric machine according to claim 1, wherein a web (145) on the inner circumference of the housing part is connected in electrically conductive fashion to a pole tube (18) of the electric motor (13).

10. The electric machine according to claim 1, wherein a web (145) on the inner circumference of the housing part is connected in electrically conductive fashion to a pole tube (18) of the electric motor (13) by abutment at a face side.

11. The electric machine according to claim 1, wherein the engagement element of the internal gear is a recess (147, 203) and the engagement element of the housing is a radial projection (163, 206), and wherein the damping element (165) surrounds the radial projection (163, 206) and is seated in the recess (147, 203).

12. The electric machine according to claim 11, wherein the recess (147) is between a first web (145) and a second web (145), wherein the first web (145) and the second web (145) are each integrally connected to the housing part and are circumferentially separated from each other, wherein the radial projection (163) radially projects into the recess (147) from the internal gear (73), and wherein the damping element (165) is between the radial projection (163) and the first web (145) and further between the radial projection (163) and the second web (145).

13. The electric machine according to claim 2, wherein the intermediate space (147) is between a first web (145) and a second web (145), wherein the first web (145) and the second web (145) are each integrally connected to the housing part and are circumferentially separated from each other, wherein the peg (163) radially projects into the intermediate space (147) from the internal gear (73), and wherein the damping element (165) is between the peg (163) and the first web (145) and further between the peg (163) and the second web (145).

14. The electric machine according to claim 2, wherein the damping element (165) surrounds the peg (163) and is seated in the intermediate space (147).

15. The electric machine according to claim 3, wherein the damping element (165) surrounds the peg (206) and is seated in the groove (203).

16. The electric machine according to claim 2, wherein a first intermediate bearing carrier (98) is arranged between the internal gear (73) and the drive element (22) and is mounted in the housing part, wherein the first intermediate bearing carrier (98) has at least one web (132), wherein a second intermediate bearing carrier (68) is arranged between the internal gear (73) and the electric motor (13) and is mounted at least partially in the housing part, wherein the second intermediate bearing carrier (68) has at least one web (180), and wherein the peg (163), the damping element (165), the web (132) of the first intermediate bearing carrier (98), and the web (180) of the second intermediate bearing (68) are seated in the recess (147) and are axially aligned.

17. The electric machine according to claim 16, wherein the damping element (165) surrounds the peg (163) such that the damping element (165) is between the peg (163) and the web (132) of the first intermediate bearing carrier (98) and further between the peg (163) and the web (180) of the second intermediate bearing carrier (68), and wherein the web (132) of the first intermediate bearing carrier (98) and the web (180) of the second intermediate bearing carrier (98) are separated in an axial direction.

18. The electric machine according to claim 17, wherein the damping element (165) is between the peg (163) and a first web (145) integrally connected to the housing and further between the peg (163) and a second web (145) integrally connected to the housing, and wherein the first web (145) and the second web (145) are separated in a circumferential direction such that the intermediate space (147) is between the first web (145) and the second web (145).

* * * * *